US008794991B2

(12) United States Patent
Ngo

(10) Patent No.: US 8,794,991 B2
(45) Date of Patent: Aug. 5, 2014

(54) ELECTRICAL CONNECTOR INCLUDING GUIDANCE AND LATCH ASSEMBLY

(75) Inventor: Hung Viet Ngo, Austin, TX (US)

(73) Assignee: FCI Americas Technology LLC, Carson City, NV (US)

( * ) Notice: Subject to any disclaimer, the term of this patent is extended or adjusted under 35 U.S.C. 154(b) by 47 days.

(21) Appl. No.: 13/571,737

(22) Filed: Aug. 10, 2012

(65) Prior Publication Data

US 2013/0040485 A1 Feb. 14, 2013

Related U.S. Application Data

(60) Provisional application No. 61/523,000, filed on Aug. 12, 2011.

(51) Int. Cl.
*H01R 13/627* (2006.01)

(52) U.S. Cl.
USPC ..... 439/350

(58) Field of Classification Search
USPC ..... 439/350, 346, 325, 157, 358, 636, 354, 439/552
See application file for complete search history.

(56) References Cited

U.S. PATENT DOCUMENTS 5,167,523 A * 12/1992 Crimmins et al. ..... 439/350
5,238,411 A * 8/1993 Jinno et al. ..... 439/59
5,472,354 A 12/1995 Chen et al.
5,511,985 A * 4/1996 Noschese et al. ..... 439/157
5,542,854 A * 8/1996 Bowen ..... 439/157
6,149,451 A * 11/2000 Weber ..... 439/358
6,217,364 B1 4/2001 Miskin et al.
6,369,336 B1 * 4/2002 Obata ..... 174/266
6,652,322 B2 * 11/2003 Ito et al. ..... 439/637
6,932,659 B1 * 8/2005 Wong ..... 439/853
7,070,464 B2 * 7/2006 Clark et al. ..... 439/825
7,137,848 B1 * 11/2006 Trout et al. ..... 439/465
7,188,408 B2 * 3/2007 Korsunsky et al. ..... 29/831
7,255,586 B2 * 8/2007 Okada ..... 439/346
7,273,382 B2 * 9/2007 Igarashi et al. ..... 439/141
7,402,055 B2 7/2008 Chen et al.
7,402,064 B2 * 7/2008 Daily et al. ..... 439/290
7,470,160 B1 * 12/2008 Mostoller et al. ..... 439/874
7,540,770 B2 * 6/2009 Ishizuka et al. ..... 439/570
7,628,636 B2 12/2009 Yu et al.
7,641,500 B2 * 1/2010 Stoner et al. ..... 439/357
7,892,015 B2 * 2/2011 Li et al. ..... 439/358
8,323,049 B2 * 12/2012 Ngo ..... 439/552
2002/0119704 A1 * 8/2002 Ito et al. ..... 439/636
2003/0219999 A1 * 11/2003 Minich et al. ..... 439/79
2004/0097118 A1 * 5/2004 Takashita ..... 439/327
2004/0121642 A1 * 6/2004 Jones et al. ..... 439/350
2006/0079119 A1 * 4/2006 Wu ..... 439/492
2006/0141849 A1 * 6/2006 Trout ..... 439/465
2006/0189195 A1 * 8/2006 Okada ..... 439/325
2007/0293084 A1 * 12/2007 Ngo ..... 439/552
2008/0305682 A1 * 12/2008 Wu ..... 439/604

* cited by examiner

*Primary Examiner* — Alexander Gilman
(74) *Attorney, Agent, or Firm* — Baker & Hostetler LLP

(57) ABSTRACT

An electrical connector assembly includes first and second electrical connectors that include complementary guidance members and complementary latch members that engage when the first and second electrical connectors are mated.

22 Claims, 8 Drawing Sheets

ELECTRICAL CONNECTOR INCLUDING GUIDANCE AND LATCH ASSEMBLY

CROSS-REFERENCE TO RELATED APPLICATIONS

This claims the benefit of U.S. Patent Application Ser. No. 61/523,000, filed Aug. 12, 2011, the disclosure of which is hereby incorporated by reference as if set forth in its entirety herein.

BACKGROUND

Electrical connector assemblies generally include a pair of electrical connectors that are configured to be mounted to a complementary electrical device, such as a printed circuit board, cable assembly, or the like, and are configured to be mated to each other so as to place the complementary electrical devices in electrical communication with each other. For instance, the electrical connectors can include a plurality of electrical contacts, which can include electrical signal contacts that carry and transmit electrically conductive paths for electrical communications data signals, and/or electrical power contacts that carry and transmit electrical power.

The electrical connectors can include latch assemblies that are designed to reliably secure the electrical connectors to each other when mated.

SUMMARY

In accordance with one embodiment, an electrical connector is configured to mate with a complementary electrical connector. The electrical connector includes a connector housing and a plurality of electrical contacts that are supported by the connector housing. The plurality of electrical contacts is configured to mate with electrical contacts of the complementary electrical connector at a mating interface. The electrical connector can include a guidance member that is configured to engage a complementary guidance member of the complementary electrical connector so as to align the electrical connector with the complementary electrical connector. The electrical connector can further include a latch member that is carried by the guidance member. The latch member is configured to engage a latch member of the complementary electrical connector so as to secure the electrical connector and the complementary electrical connector when the electrical connector is mated with the complementary electrical connector.

BRIEF DESCRIPTION OF THE DRAWINGS

The foregoing summary, as well as the following detailed description of the preferred embodiments of the application, will be better understood when read in conjunction with the appended drawings. For the purposes of illustration, there are shown in the drawings preferred embodiments. It should be understood, however, that the instant application is not limited to the precise arrangements and/or instrumentalities illustrated in the drawings, in which.

DETAILED DESCRIPTION

Figure 1A:
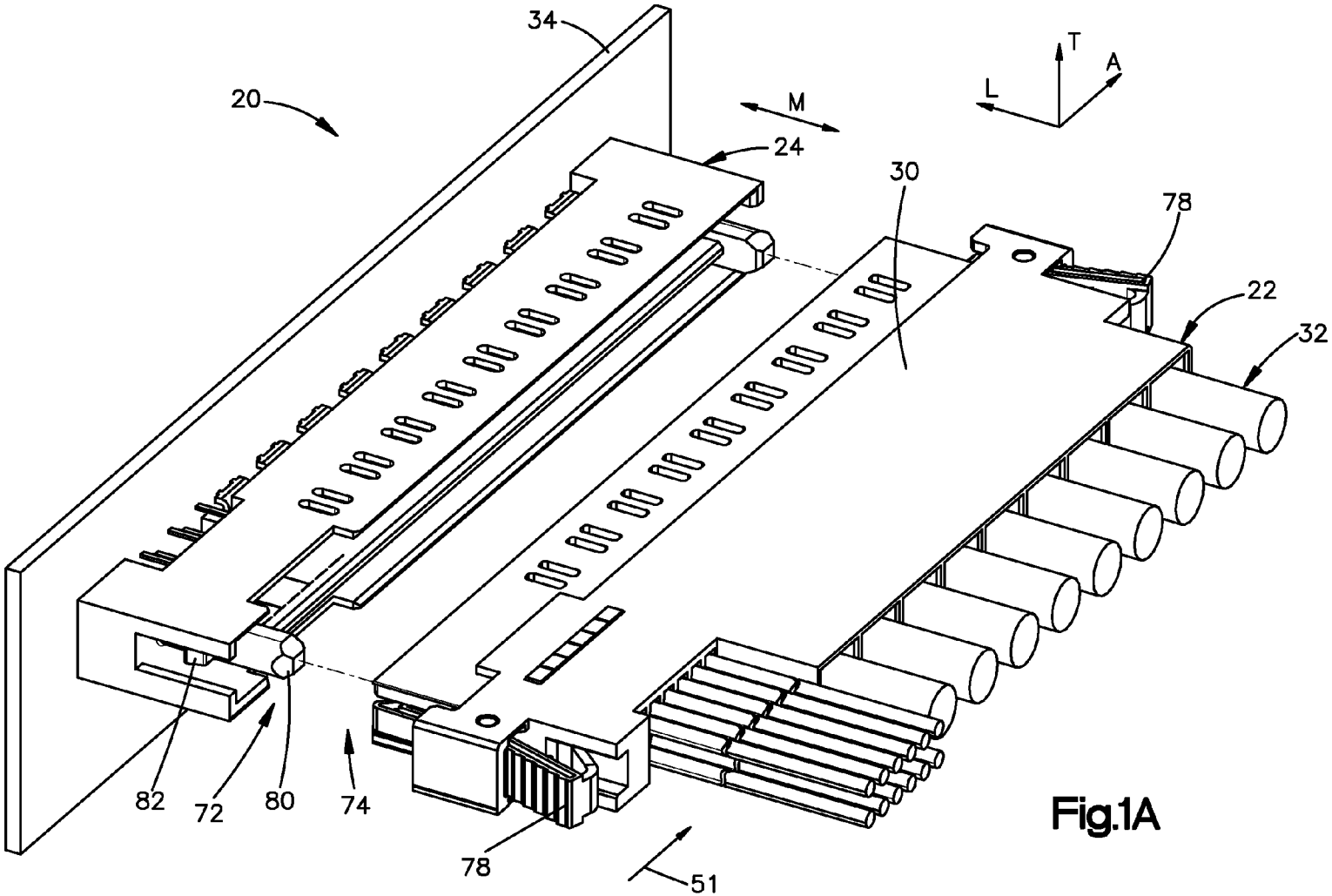
FIG. 1A is a perspective view of an electrical connector assembly including a first electrical connector mounted to a first complementary electrical device, and a second electrical connector mounted to a complementary electrical device.
Figure 1B:
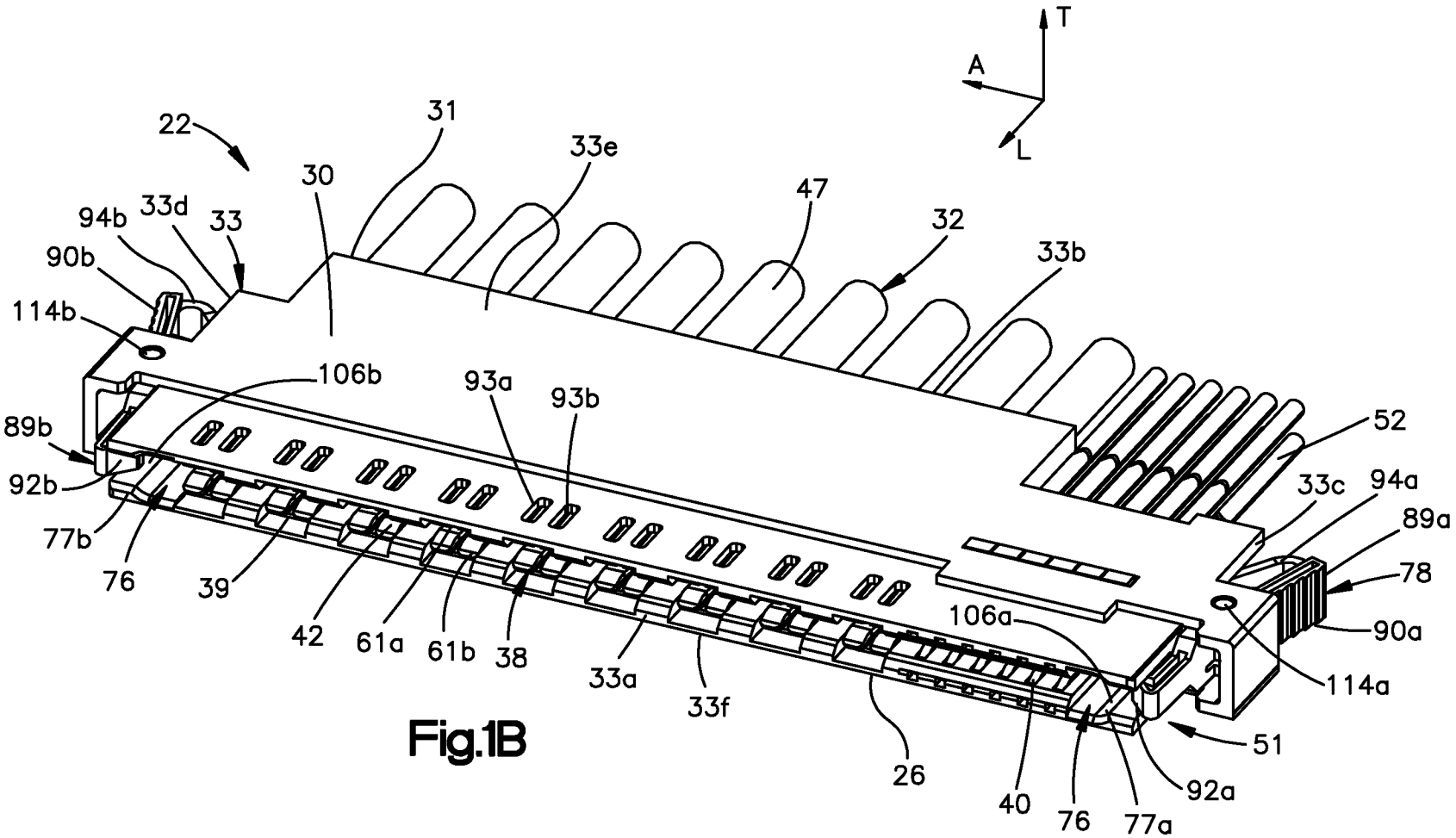
FIG. 1B is a perspective view of the first electrical connector illustrated in FIG. 1A, shown mounted to the first complementary electrical device.
Figure 1C:
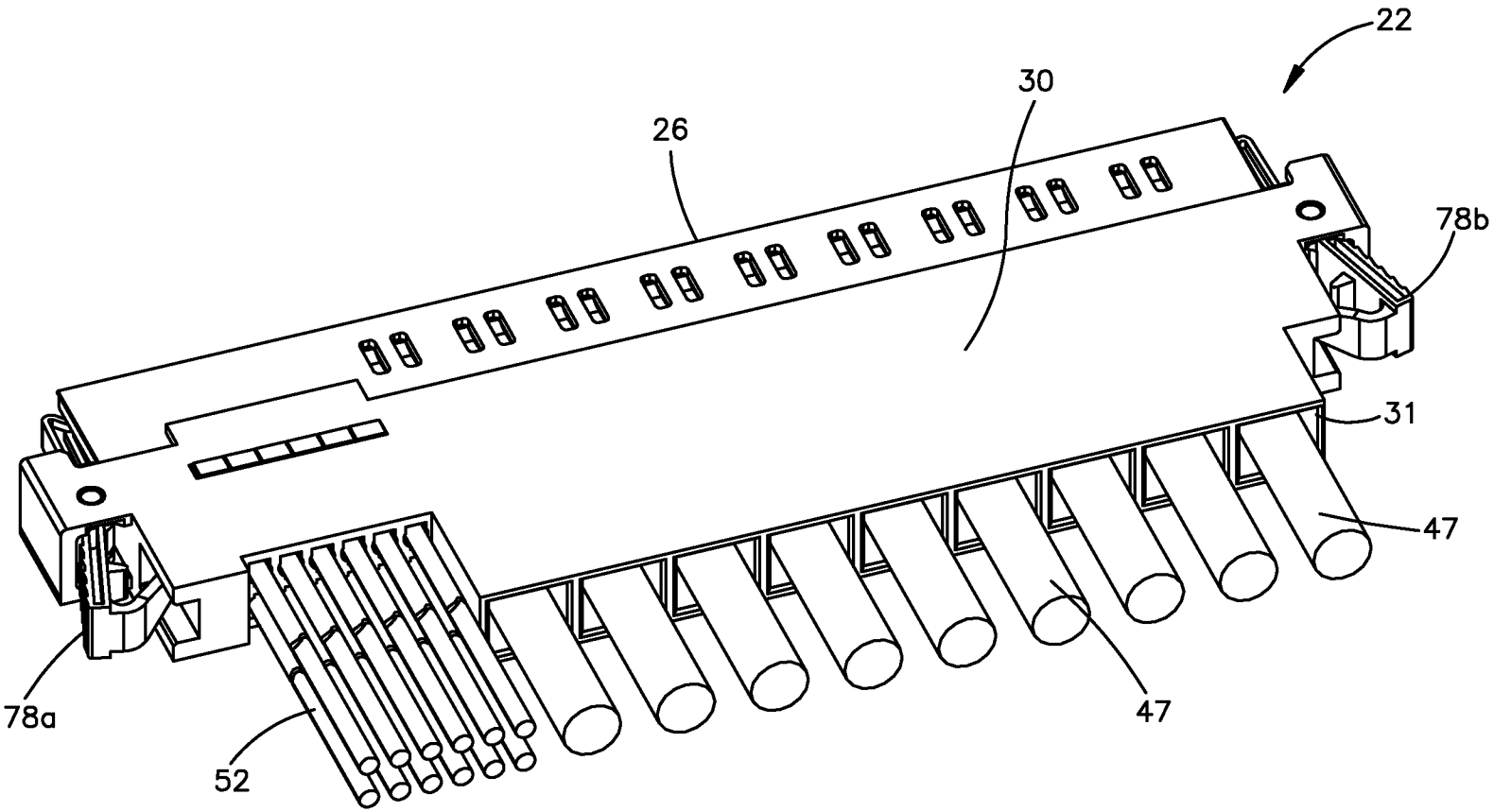
FIG. 1C is another perspective view of the first electrical connector illustrated in FIG. 1A, shown mounted to the first complementary electrical device.

One aspect of the present disclosure provides a retention assembly that is configured to guide first and second electrical connectors to a mated configuration, and to physically secure first and second electrical connectors when in the mated configuration. Referring to FIGS. 1A-1D, an electrical connector assembly 20 constructed in accordance with one embodiment includes a first electrical connector 22 and a second electrical connector 24 that are configured to be mated to each other, and mounted to respective first and second complementary electrical devices. For example, in accordance with the illustrated embodiment, the first electrical connector 22 can be configured as an electrical cable connector that is configured to be mounted to a cable assembly 32 that can include a plurality of electrically conductive cables including at least one or both of power cables 47 and signal cables 52. The second electrical connector 24 is configured to be mounted to a substrate 34, which can be configured as a printed circuit board, in accordance with the illustrated embodiment. In accordance with an alternative embodiment illustrated in FIG. 4, the first complementary electrical device can be configured as a substrate 35, such as a printed circuit board.

The first electrical connector 22 includes a dielectric or electrically insulative first connector housing 30 and a first plurality of electrical contacts 38 that are supported by the first connector housing 30. Similarly, the second electrical connector 24 includes a dielectric or electrically insulative second connector housing 60 and a second plurality of electrical contacts 62 that are supported by the second connector housing 60. The first electrical connector 22 defines a mounting interface 31 that is configured to be mounted onto the cable assembly 32, thereby placing the first plurality of electrical contacts 38 in electrical communication with the cable assembly 32. The second electrical connector 24 further defines a mounting interface 27 that is configured to be mounted onto the substrate 34.

The first electrical connector 22 further defines a mating interface 26, and the second electrical connector 24 similarly defines a mating interface 28. The first and second electrical connectors 22 and 24 are configured to mate with each other at their respective mating interfaces 26 and 28, thereby placing the first plurality of electrical contacts 38 of the first electrical connector 22 in electrical communication with the second plurality of electrical contacts 62 of the second electrical connector 24. As will be described in more detail below, the electrical connector assembly 20 can include a guidance assembly 72 and an attachment assembly 74, which can be configured as a latch assembly. For instance, the first electrical connector 22 can include a first guidance member 76 and a first attachment member 78, and the second electrical connector 24 can include a second guidance member 80 and a second attachment member 82. Thus, the guidance assembly 72 can include the first guidance member 76 and the second guidance member that are configured to mate with each other so as to align the first connector housing 30 with the second connector housing 60 so that the first and second electrical connectors 22 and 24 can be mated by moving at least one of the first and second electrical connectors 22 and 24 relative to the other of the first and second electrical connectors 22 and 24 substantially along the longitudinal direction L. The attachment assembly 74 can include the first attachment member 78 and the second attachment member 82 which can mate with each other so as to secure, for instance removably secure, the first connector housing 30 to the second connector housing 60 when the first and second electrical connectors 22 and 24 when mated.

Various structures are described herein as extending horizontally along a longitudinal direction "L" and lateral direction "A" that is substantially perpendicular to the longitudinal direction L, and vertically along a transverse direction "T" that is substantially perpendicular to the longitudinal and lateral directions L and A, respectively. As illustrated, the longitudinal direction "L" extends along a forward/rearward direction of the electrical connector assembly 20, and defines a mating direction M along which one or both of the first and second electrical connectors 22 and 24 are moved relative to the other so as to mate with the other electrical connector. The lateral direction "A" extends along a width of each of the first and second electrical connectors 22 and 24, respectively, and the transverse direction "T" extends along a height of each of the first and second electrical connectors 22 and 24. Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 20 and its components as illustrated merely for the purposes of clarity and convenience, it being appreciated that these orientations may change during use.

The first connector housing 30 includes a housing body 33 that defines a front end 33*a* and an opposed rear end 33*b* spaced from the front end 33*a* along the longitudinal direction L, first and second opposed sides 33*c* and 33*d* that are spaced from each other along the lateral direction A, and a top end 33*e* and an opposed bottom end 33*f* that is spaced from the top end 33*e* along the transverse direction T. The front end 33*a* of the housing body 33 can define the mating interface 26 of the first electrical connector 22, and the rear end 33*b* can define the mounting interface 31 of the first electrical connector 22. Accordingly, the mating interface 26 and the mounting interface 31 are oriented substantially parallel to each other in accordance with the illustrated embodiment, and the first electrical connector 22 can be referred to as a vertical electrical connector. It should be appreciated, however, that the first electrical connector can alternatively be a right-angle connector, whereby the mating interface 26 and the mounting interface 31 are oriented substantially perpendicular to each other.

With continuing reference to FIGS. 1A-D, the first plurality of electrical contacts 38 of the first electrical connector 22 can include at least one electrical signal contact 40 such as a plurality of electrical signal contacts 40, and at least one electrical power contact 42 such as a plurality of electrical power contacts 42. In accordance with the illustrated embodiment, the electrical signal contacts 40 are disposed adjacent the first side 33*c*, and the electrical power contacts 42 are disposed adjacent the second side 33*c*. Accordingly, the electrical signal contacts 40 can be disposed between the electrical power contacts 42 and the first side 33*c*, and the electrical power contacts 42 can be disposed between the electrical signal contacts 40 and the second side 33*d*. In accordance with alternative embodiments, the first electrical connector can be devoid of electrical signal contacts 40, such that the first plurality of electrical contacts 38 includes only electrical power contacts 42.

The first plurality of electrical contacts 38 can define mating ends 39 that are configured to mate with the complementary mating ends 120 of the second plurality of electrical contacts 62 of the second electrical connector 24 so as to mate the first electrical connector 22 with the second electrical connector 24. The mating ends 39 of the first plurality of electrical contacts 38 can be arranged in first and second rows 61*a* and 61*b* that are spaced from each other along the transverse direction T, so as to define a gap 63 that extends along the transverse direction T between the first row 61*a* and the second row 61*b*. Each of the first and second rows 61*a* and 61*b* extends along a row direction 51, which can be the lateral direction A in accordance with the illustrated embodiment. The front end 33*a* of the housing body 33 can define a receptacle that is configured to receive a portion of the second electrical connector 24 that carries the mating ends 120 of the second plurality of the second plurality of electrical contacts 62 when the first and second electrical connectors 22 and 24 are mated, such that the gap 63 receives the mating ends of the second plurality of electrical contacts 62, thereby placing the first plurality of electrical contacts 38 and 62 in electrical communication with each other.

Accordingly, the first electrical connector 22 can be referred to as a receptacle connector in accordance with the illustrated embodiment, whereby the corresponding electrical signal contacts 40 and electrical power contacts 42 are configured to receive the second plurality of electrical contacts 62 of the second electrical connector 24 so as to mate the first electrical connector 22 with the second electrical connector 24. It should be appreciated, however, that the first electrical connector 22 can alternatively be configured as a header or plug connector, whereby the first plurality of electrical contacts 38 are configured to be received by the second plurality of electrical contacts 62 of the second electrical connector 24 so as to mate the first electrical connector 22 to the second electrical connector 24.

With continuing reference to FIGS. 1A-2D, each of the first plurality of electrical contacts 38 defines a mounting end that is configured to be attached to the first complementary electrical device. For instance, each of the electrical signal contacts 40 defines a mounting end 65 that is configured to be mounted to at least one complementary signal cable 52 so as to define a corresponding plurality of signal contact assemblies 46. Furthermore, each of the electrical power contacts 42 defines a mounting end 67 that is configured to be mounted to at least one complementary power cable 47 so as to define a corresponding plurality of power contact assemblies 44. In accordance with the illustrated embodiment, the mating ends 39 of the first plurality of electrical contacts 38 are disposed proximate to the mating interface 26, and thus proximate to the front end 33*a* of the housing body 33. Further, in accordance with the illustrated embodiment, the mounting ends of the first plurality of electrical contacts 38 are disposed proximate to the mounting interface 31, and thus proximate to the rear end 33*b* of the housing body. Accordingly, the mating ends 39 are oriented substantially parallel to the mounting ends of the first plurality of electrical contacts 38, and the first plurality of electrical contacts 38 can be referred to as vertical electrical contacts. It should be appreciated, however, that the first plurality of electrical contacts 38 can be configured as right-angle electrical contacts whereby the mating ends 39 of the first plurality of electrical contacts 38 are oriented substantially perpendicular to each other. For instance, the mating ends 39, and thus the mating interface 26, can be disposed proximate the front end 33*a* of the housing body 33, and the mounting ends of the first plurality of electrical contacts 38, and thus the mounting interface 31, can be disposed proximate the bottom end 33*f* of the housing body 33.

Figure 2A:
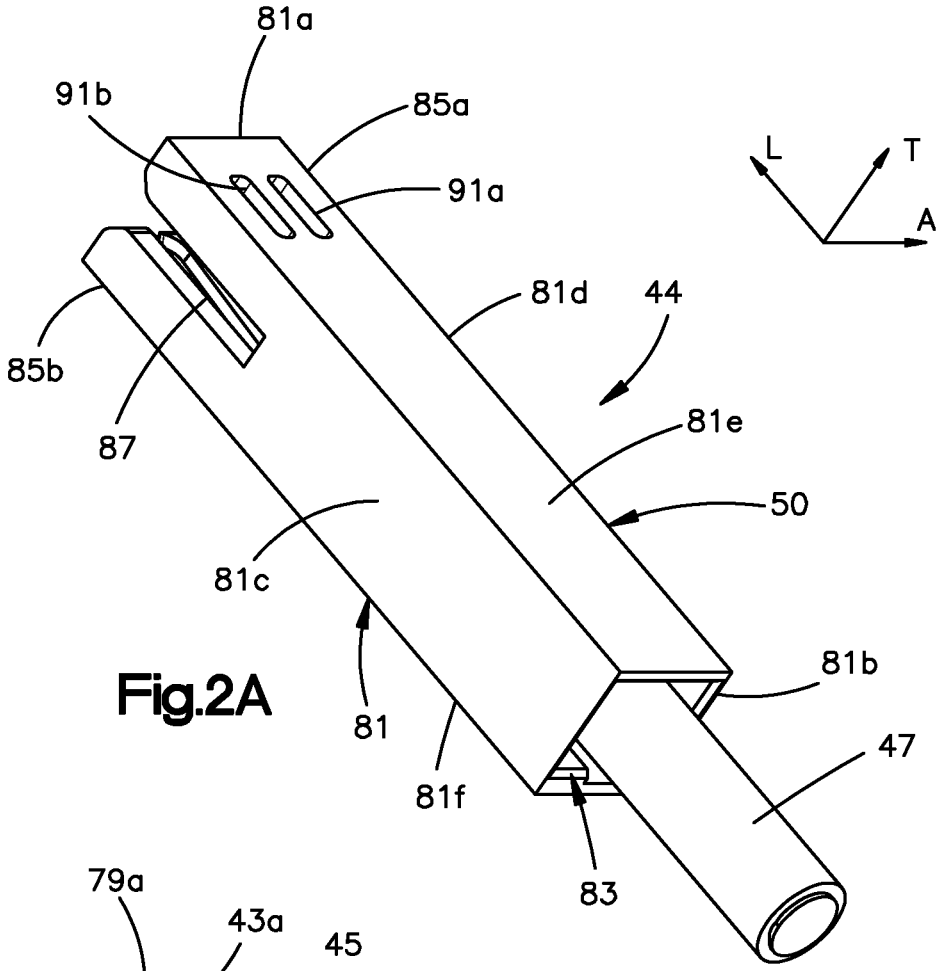
FIG. 2A is a perspective view of a power contact assembly of the first electrical connector.
Figure 2B:
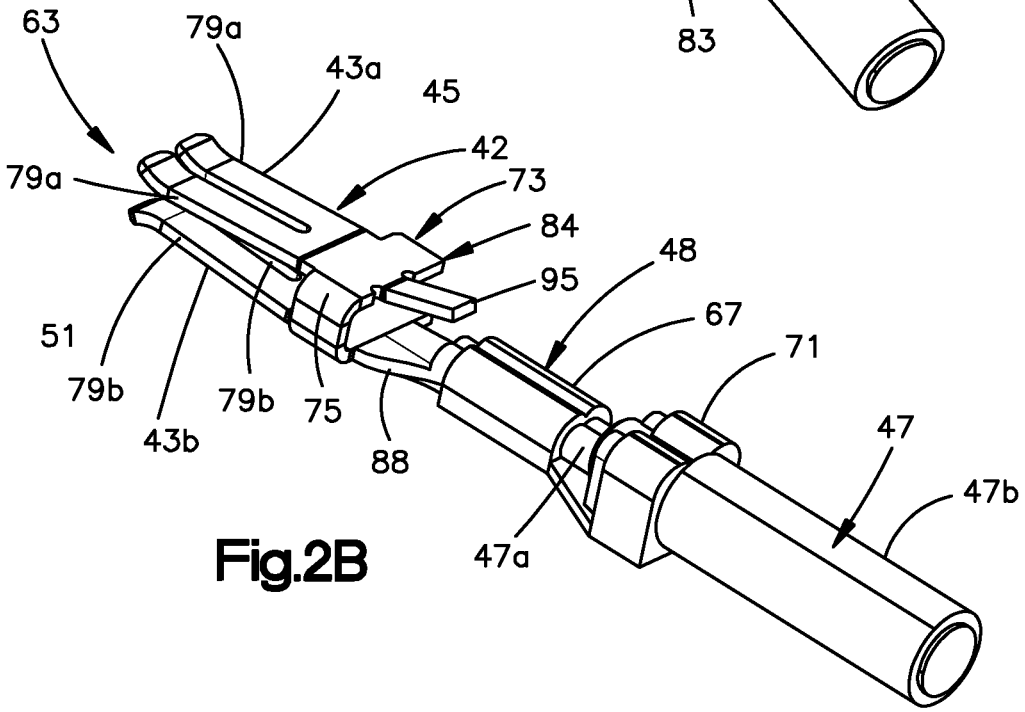
FIG. 2B is a perspective view of a portion of the power contact assembly illustrated in FIG. 2A.

Referring now to FIGS. 2A-B, each power contact assembly 44 can include a power cable 47 and at least one power contact 42 that is crimped or otherwise attached to the power cable 47 at an interface 48 between each respective mounting end 67 and a complementary one of the power cables 47, so as to place the electrical power contact 42 and the power cable 47 in electrical communication. For instance, each power cable 47 includes an electrically conductive portion, such as an electrically conductive wire 47*a*, and an electrically insulative portion, such as an electrically insulative sheath 47*b*, that surrounds the wire 47*a*. The mounting ends 67 of the electrical power contacts 42 can be crimped about the wire 47*a* of the complementary power cable 47 so as to place the power cable 47 in electrical communication with the corresponding electrical power contact 42. Each electrical power contact 42 can further include a strain relief member 71 that is disposed rearward of the mounting end 67, and can be attached to the complementary power cable. For instance, the strain relief member 71 can be crimped about the sheath 47*b*, such that a majority of a rearwardly directed tensile force applied to the power cable 47 at a location rearward of the strain relief member 71 is absorbed at an interface between the strain relief member and the sheath 47*b*. Thus, the majority of the rearwardly directed tensile force is isolated from the interface 48 between the mounting end 67 and the wire 47*a*.

The electrical power contacts 42 can each include a contact body 84 that defines a mating end 45, the mounting end 67 that includes at least one first or upper beam 43*a* and at least one second or lower beam 43*b*, a lead portion 73 that is connected between the mating end 45 and the mounting end 67, and the strain relief member 71. In accordance with the illustrated embodiment, the mating end 45, the mounting end 67, the lead portion 73, and the strain relief member 71 are integral and monolithic with each other. The lower beam 43*b* is spaced from the upper beam 43*a* along the transverse direction T, such that the upper beam 43*a* is disposed in the first row 61*a* and the lower beam 43*b* is disposed in the second row 61*b* (see FIG. 1B), and the gap 63 is disposed between the upper and lower beams 43*a* and 43*b*. The lead portion 73 can include a strap 75 that is attached between the upper and lower beams 43*a* and 43*b* so as to support the upper and lower beams 43*a* and 43*b* in the respective first and second rows 61*a* and 61*b*. The lead portion 73 can further include a neck 88 that extends from the mounting end 67 to the strap 75, for instance at a location substantially aligned with the lower beam 43*b*, such that the strap extends from the strap 75 and attaches to both the lower beam 43*b* and the upper beam 43*a*.

Each of the upper and lower beams 43*a* and 43*b* can be cantilevered from the lead portion 73, and in particular from the strap 75. At least a first portion, such as a rear portion, of the upper beams 43*a* can extend toward the lower beams 43*b*, and a second portion, such as a front portion, of the upper beams 43*a* can extend away from the lower beams 43*b*. Similarly, at least a first portion, such as a rear portion, of the lower beams 43*b* can extend toward the upper beams 43*a*, and a second portion, such as a rear portion, of the lower beams 43*b* can extend away from the upper beams 43*a*. The front end of the upper and lower beams 43*a* and 43*b* can be split as desired such that each of the upper and lower beams 43*a* and 43*b* defines first and second fingers 79*a* and 79*b*, respectively, that are spaced from each other along the row direction 51.

Each power contact assembly 44 can include an electrically insulative power contact retainer 50 that supports the power cable 47 and the electrical power contact 42. For instance, the power contact retainer 50 can include a body 81 that defines a front end 81*a* and an opposed rear end 81*b* that is spaced from the front end 81*a* along the longitudinal direction L, first and second opposed sides 81*c* and 81*d* that are spaced from each other along the lateral direction A, and a top end 81*e* and an opposed bottom end 81*f* that is spaced from the top end 81*e* along the transverse direction T. The power contact retainer 50 can be supported by the first connector housing 30 such that the front end 81*a* is disposed proximate to the mating interface 26 of the first electrical connector 22, and the rear end 81*b* is disposed proximate to the mounting interface 31 of the first electrical connector 22.

The power contact retainer 50 can define an opening 83 that extends forward through the rear end 81*b* of the body 81 along the longitudinal direction L toward the front end 50*a*. The power contact retainer 50 further includes upper and lower opposed retainer arms 85*a* and 85*b* that extend forward from the body 81, for instance from the front end 81*a*, along the longitudinal direction L. Each retainer arm 85*a* and 85*b* defines a surface that faces the other of the upper and lower retainer arms 85*a* and 85*b*, and defines a pocket 87 that extends into the surface along the transverse direction T, such that at least a first portion of the respective upper and lower beams 43*a* and 43*b* is at least partially disposed in the respective pockets 87, and a second portion of the respective upper and lower beams 43*a* and 43*b* protrudes from the respective surface toward the opposed ones of the upper and lower retainer arms 85*a* and 85*b*.

The power contact retainer 50 can further define at least one heat dissipation window that can extend through at least one such as both of the upper and lower retainer arms 85*a* and 85*b* along the transverse direction T, and can be aligned with the respective electrical power contact 42, for instance at the mating end 45. In accordance with the illustrated embodiment, the power contact retainer 50 defines first and second heat dissipation windows 91*a* and 91*b* that extends through each of the upper and lower retainer arms 85*a* and 85*b* along the transverse direction T in at least partial alignment, such as alignment, with the first and second fingers 79*a* and 79*b*, respectively. For instance, the first and second heat dissipation windows 91*a* and 91*b* that extend through the upper retainer arm 85*a* can be aligned with the first and second fingers 79*a* and 79*b* of the upper beam 43*a*, and the first and second heat dissipation windows 91*a* and 91*b* that extend through the lower retainer arm 85*b* can be aligned with the first and second fingers 79*a* and 79*b* of the lower beam 43*b*. The first and second windows 91*a* and 91*b* that extend through the upper and lower retainer arms 85*a* and 85*b* can further be aligned with respective first and second heat dissipation windows 93*a* and 93*b* that extend through the housing body 33 of the first connector housing 30 (see FIG. 1B), and can extend for instance through the top and bottom ends 33*e* and 33*f* of the housing body 33 along the transverse direction T. Accordingly, during operation, heat disposed at the mating ends 45 of the electrical power contacts 42 can travel through the first and second windows 91*a* and 91*b*, and further through the first and second windows 93*a* and 93*b*, respectively, and out the first connector housing 30.

Accordance with the illustrated embodiment, the electrical power contacts 42 and power cables 47 can be inserted into the power contact retainer 50 after the mounting end 67 has been attached to the power cable 47. For instance, with continuing reference to FIGS. 2A-B, each of the electrical power contacts 42 can include at least one retention flange 95 that resiliently extends from the contact body 84 rearward along the longitudinal direction L and up along the transverse direction T. For instance, the retention flange 95 can extend from the strap 75, and is configured to mate with a complementary recess disposed in the body 81 of the power contact retainer 50 as the electrical power contacts 42 are inserted forward along the longitudinal direction L through the opening 83 of the rear end 81*b* of the body 81 until the mating end 45 is disposed in the respective pocket 87, and the complementary power cable 47 extends rearward along the longitudinal direction L out the opening 83. Alternatively, the electrical power contacts 42 can be overmolded by the respective power contact retainers 50. The power contact assemblies 44 can then be installed in the first connector housing 30 by securing the power contact retainers 50 in the housing body 33.

Figure 2C:
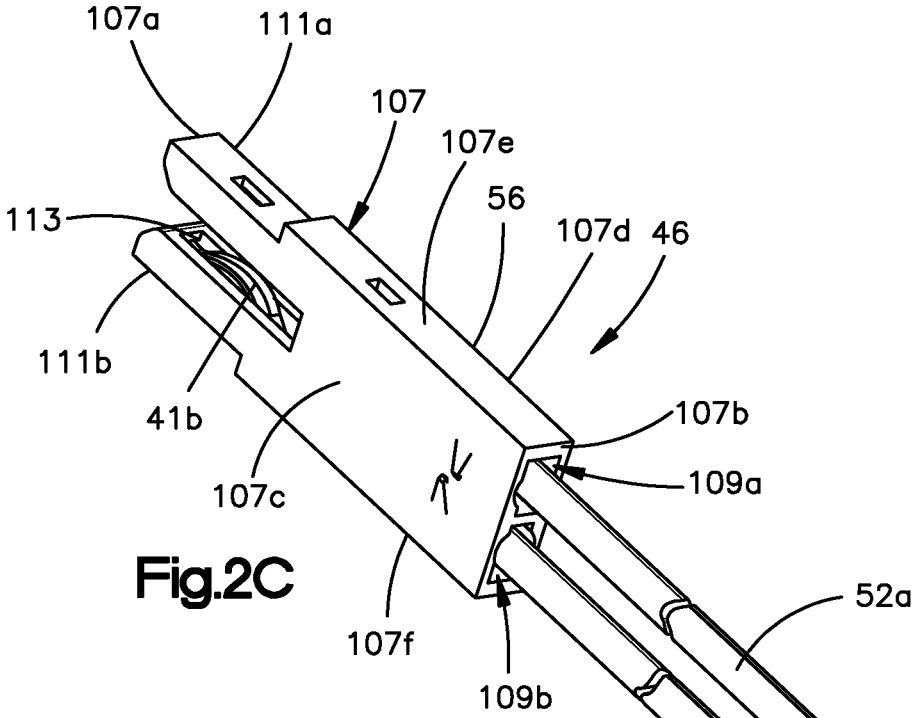
FIG. 2C is a perspective view of a signal contact assembly of the first electrical connector.
Figure 2D:
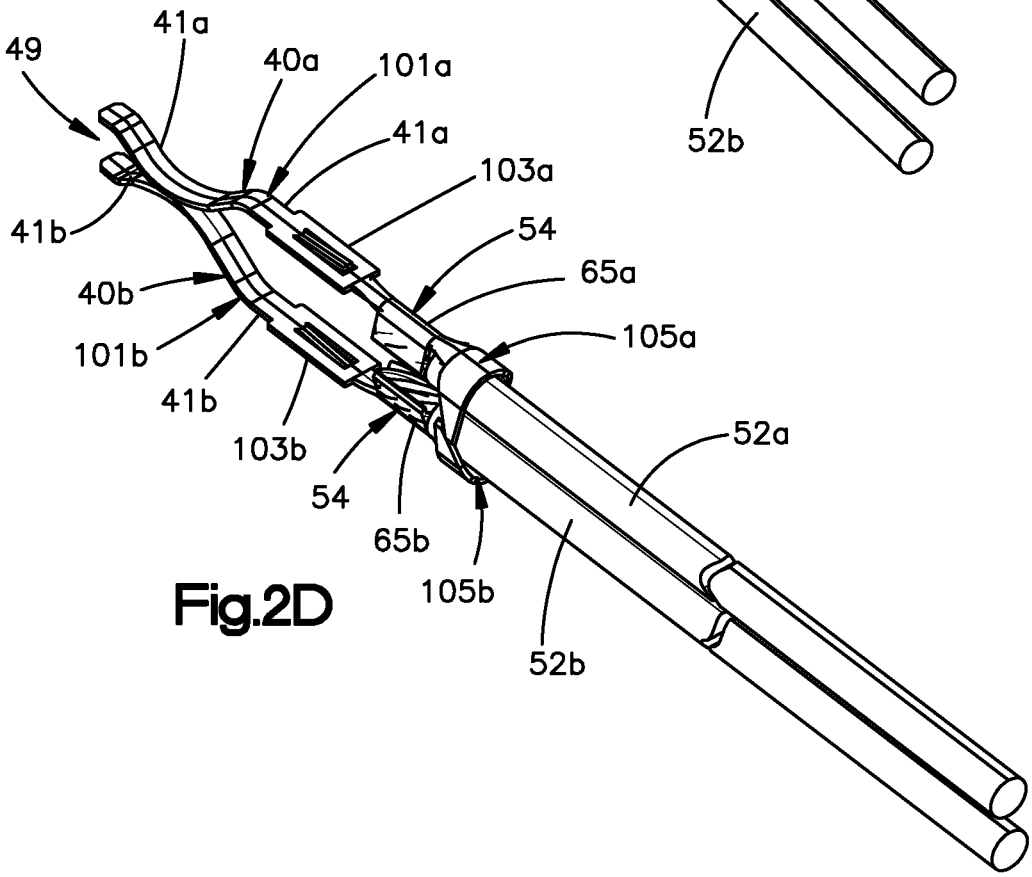
FIG. 2D is a perspective view of a portion of the signal contact assembly illustrated in FIG. 2C.
Figure 3B:
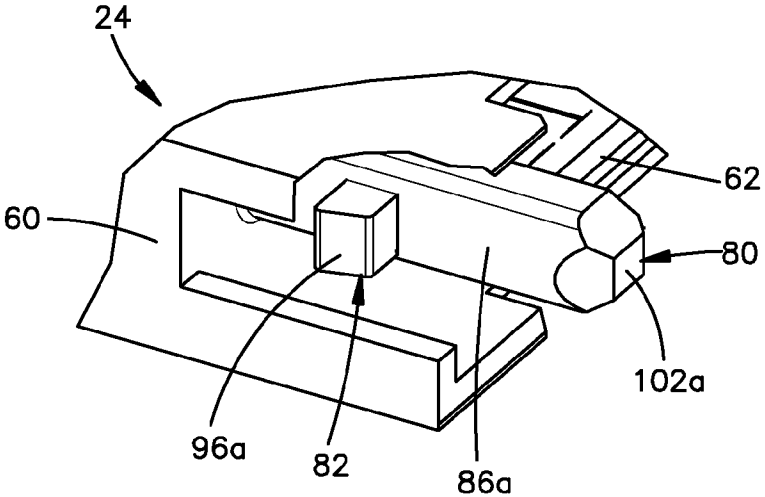
FIG. 3B is an enlarged perspective view of a portion of the first electrical connector, showing a first guidance member and a first latch member of the latch and guidance systems, respectively.
Figure 3A:
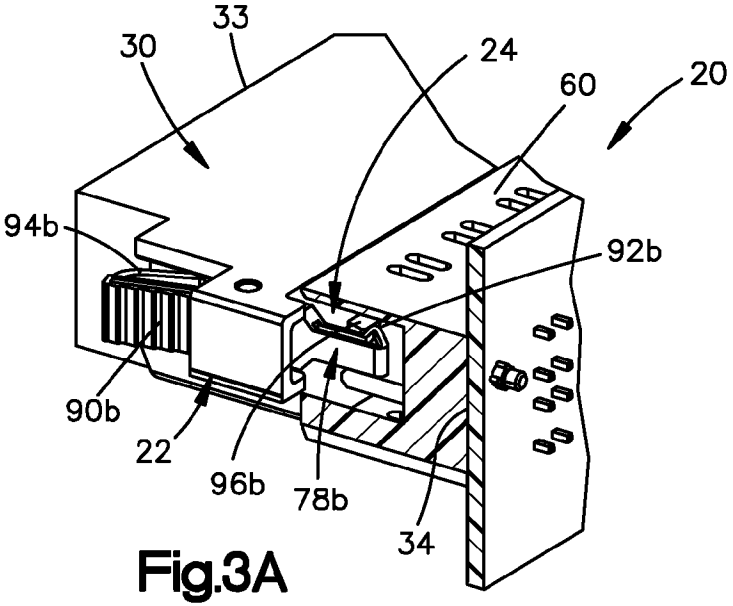
FIG. 3A is an enlarged perspective view of a portion of the electrical connector assembly illustrated in FIG. 1A, showing a latch system and a guidance system.
Figure 3C:
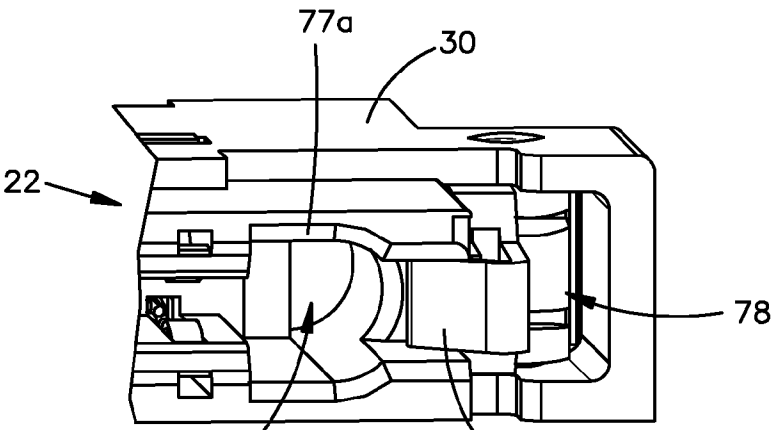
FIG. 3C is an enlarged perspective view of a portion of the second electrical connector showing a second guidance member configured to engage the first guidance member illustrated in FIG. 3B, and a second latch member configured to engage the first latch member illustrated in FIG. 3A.

Referring now to FIGS. 2C-D, each signal contact assembly 46 can include at least one signal cable 52 and a corresponding at least one electrical signal contact 40 that is crimped or otherwise secured to the at least one signal cable 52 at an interface 54, so as to place at least one electrical signal contact 40 and the signal cable 52 in electrical communication. Each signal contact assembly 46 can further include a signal contact retainer 56 that supports the at least one signal cable 52 and the corresponding at least one electrical signal contact 40. In accordance with the illustrated embodiment, the signal contact assembly 46 includes a first or upper signal cable 52*a* and a second or lower signal cable 52*b* that is spaced from the upper signal cable 52*a* along the transverse direction T, and a corresponding first or upper electrical signal contact 40*a* and a second or lower electrical signal contact 40*b* that is spaced from the upper electrical signal contact 40*a* along the transverse direction T. The upper electrical signal contact 40*a* is configured to be mounted to the upper signal cable 52*a*, and the lower electrical signal contact 40*b* is configured to be mounted to the lower signal cable 52*b*. Unless otherwise indicated, reference to the electrical signal contacts 40 and the signal cables 52, and components thereof, refers to both the upper and lower electrical signal contacts 40*a* and 40*b*, and the upper and lower signal cables 52*a* and 52*b*, and components thereof, respectively.

In accordance with the illustrated embodiment, each of the upper electrical signal contacts 40*a* can include a respective upper contact body 101*a* that defines an upper mating end 41*a*, an upper mounting end 65*a*, and an upper lead portion 103*a* that extends between the upper mounting end 65*a* and the upper mating end 41*a*. Each of the upper electrical signal contacts 40*a* can further include an upper strain relief member 105*a* that extends rearward from the upper mounting end 65*a* along the longitudinal direction L. Similarly, each of the lower electrical signal contacts 40*b* can include a respective lower contact body 101*b* that defines a lower mating end 41*b*, a lower mounting end 65*b*, and a lower lead portion 103*b* that extends between the lower mounting end 65*b* and the lower mating end 41*b*. Each of the lower electrical signal contacts 40*b* can further include lower strain relief member 105*b* that extends rearward from the lower mounting end 65*b* along the longitudinal direction L. In accordance with the illustrated embodiment, the mating end 45, the upper and lower mounting ends 65*a-b*, lead portion 73, and the strain relief member 105 are integral and monolithic with each other.

Each signal cable 52 includes an electrically conductive portion, such as an electrically conductive wire 53*a*, and an electrically insulative portion, such as an electrically insulative sheath 53*b*, that surrounds the wire 53*a*. The mounting ends 65 of the electrical signal contacts 40 can be crimped about the wire 53*a* of the complementary signal cable 52 so as to place the wire 53*a* in electrical communication with the respective electrical signal contact 40. The strain relief member 105 can be attached to the complementary signal cable 52. For instance, the strain relief member 105 can be crimped about the sheath 53*b*, such that a majority of a rearwardly directed tensile force applied to the signal cable 52 at a location rearward of the strain relief member 105 is absorbed at an interface between the strain relief member 105 and the sheath 53*b*. Thus, the majority of the rearwardly directed tensile force is isolated from the interface 54 between the mounting end 65 and the wire 53*a*.

The upper electrical signal contacts 40*a* are spaced from the lower electrical signal contacts 40*b* along the transverse direction T, such that the upper electrical signal contact 40*a* is disposed in the first row 61*a* and the lower electrical signal contact 40*b* is disposed in the second row 61*b* (see FIG. 1B), and the gap 63 is disposed between the upper and lower electrical signal contacts 40*a* and 40*b*.

Each of the mating ends 41 can be cantilevered from the lead portion 103, such that at least a first portion, such as a rear portion, of the upper mating ends 41*a* can extend toward the lower mating ends 41*b*, and a second portion, such as a front portion, of the upper mating ends 41*a* can extend away from the lower mating ends 41*b*. Similarly, at least a first portion, such as a rear portion, of the lower mating ends 41*b* can extend toward the upper mating ends 41*a*, and a second portion, such as a rear portion, of the lower mating ends 41*b* can extend away from the upper mating ends 41*a*.

Each signal contact assembly 46 can include an electrically insulative signal contact retainer 56 that supports one of the upper signal cables 52*a* and one of the lower signal cables 52*b* that is aligned with the one of the upper signal cables 52*a* along the transverse direction T. For instance, the signal contact retainer 56 can include a body 107 that defines a front end 107*a* and an opposed rear end 107*b* that is rearwardly spaced from the front end 107*a* along the longitudinal direction L, first and second opposed sides 107*c* and 107*d* that are spaced from each other along the lateral direction A, and a top end 107*e* and an opposed bottom end 107*f* that is downwardly spaced from the top end 107*e* along the transverse direction T. The signal contact retainer 56 can be supported by the first connector housing 30 such that the front end 107*a* is disposed proximate to the mating interface 26 of the first electrical connector 22, and the rear end 107*b* is disposed proximate to the mounting interface 31 of the first electrical connector 22.

The signal contact retainer 56 can define at least one opening that extends forward through the rear end 107*b* of the body 81 along the longitudinal direction L toward the front end 50*a*. For instance, the signal contact retainer 56 can define an upper opening 109*a* and a lower opening 109*b* that is spaced from the upper opening 109*a* along the transverse direction. The signal contact retainer 56 further includes upper and lower opposed retainer arms 111*a* and 111*b* that extend forward from the body 107, for instance from the front end 107*a*, along the longitudinal direction L. Each retainer arm 111*a* and 111*b* defines a surface that faces the other of the retainer arms 111*a* and 111*b*, and defines a pocket 113 that extends into the surface along the transverse direction T, such that at least a first portion of the respective upper and lower mating ends 41*a* and 41*b* is at least partially disposed in the respective pockets 113, and a second portion of the respective upper and lower mating ends 41*a* and 41*b* protrudes from the respective surface toward the opposed ones of the retainer arms 111*a* and 111*b*.

Accordance with the illustrated embodiment, the electrical power contacts 42 and power cables 47 can be inserted into the power contact retainer 50 after the mounting end 67 has been attached to the power cable 47. Alternatively, the electrical power contacts 42 can be overmolded by the respective power contact retainers 50. The power contact assemblies 44 can then be installed in the first connector housing 30 by securing the power contact retainers 50 in the housing body 33. It should be further appreciated that the mating ends 39 of the first plurality of electrical contacts 38 can include either or both of the mating ends 45 of the electrical power contacts 42 and the mating ends 41 of the electrical signal contacts 40, and that the mounting ends of the first plurality of electrical contacts 38 can include either or both of the mounting ends 67 of the electrical power contacts 42 and the mounting ends 65 of the plurality of electrical signal contacts 40.

As described above with reference to FIG. 4, the first complementary electrical device can be configured as a substrate 35, such as a printed circuit board. Accordingly, the mounting ends 67 of the electrical power contacts 42 can be mounted to the printed circuit board and placed in electrical communication with electrical traces of the printed circuit board that are configured to carry power, and the mounting ends 65 of the electrical signal contacts 40 can be mounted to the printed circuit board and placed in electrical communication with electrical traces of the printed circuit board that are configured to carry data signals.

Figure 1D:
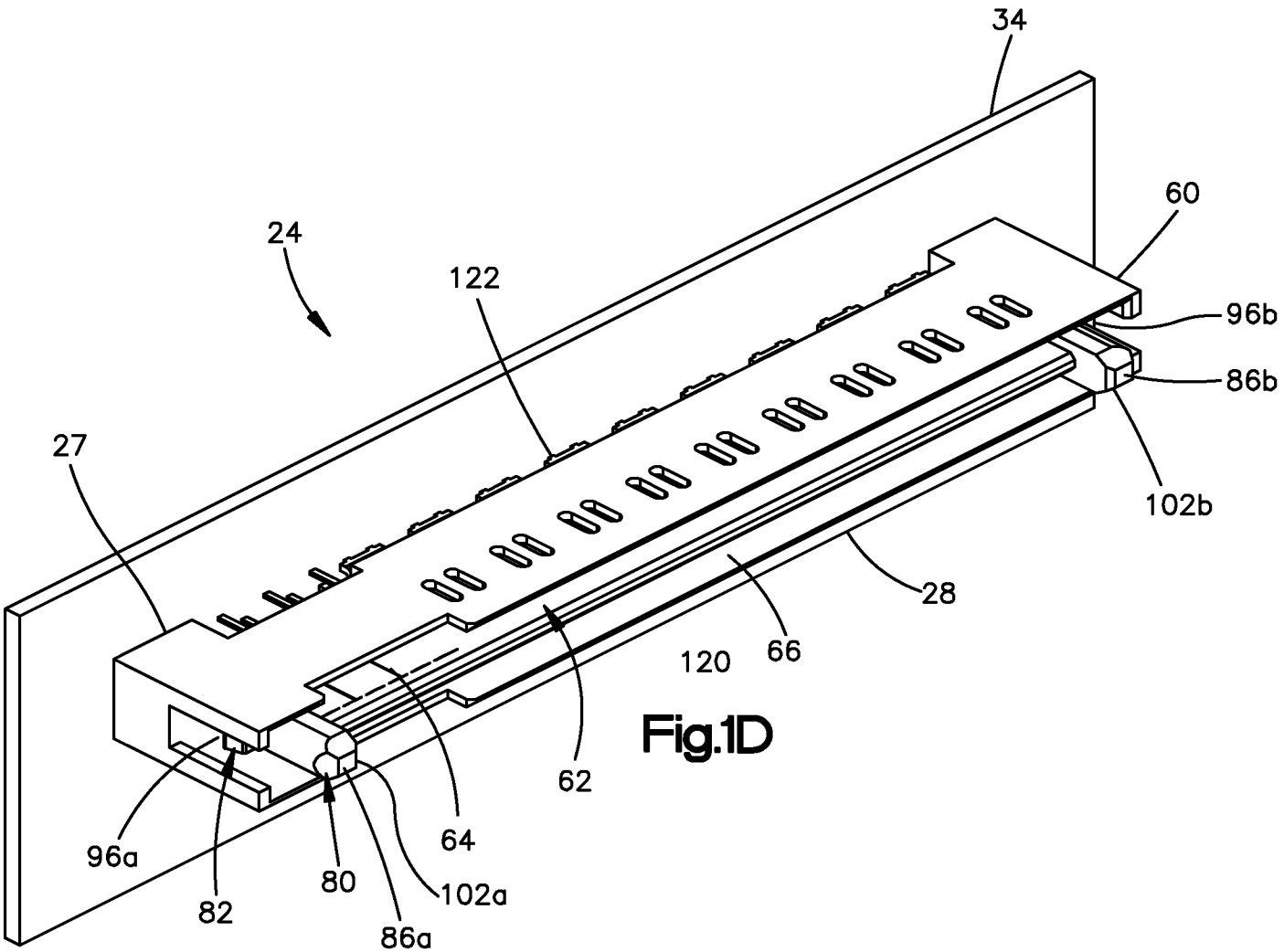
FIG. 1D is a perspective view of the second electrical connector illustrated in FIG. 1A, shown mounted to the second complementary electrical device.

Referring now to FIG. 1D, the second electrical connector 24 includes a dielectric or electrically insulative second connector housing 60 and a second plurality of electrical contacts 62 that are supported by the second connector housing 60. For instance, the second plurality of electrical contacts 62 are complementary to the first plurality of electrical contacts 38, and can thus include either or both of a plurality of electrical signal contacts 64 and a plurality of electrical power contacts 66. The second plurality of electrical contacts 62 can define respective mating ends 120 and mounting ends 122 that can be mated with the mating ends 39 of the first plurality of electrical contacts 38 and mounting to the second complementary electrical device, such as the substrate 34, respectively.

In accordance with the illustrated embodiment, the second plurality of electrical contacts 62 are configured to be inserted into the receptacle defined by the front end 33*a* of the housing body 33, and into the gap 63 defined by the mating ends 39 of the first plurality of electrical contacts 38, thereby placing the first plurality of electrical contacts 38 in electrical communication with the second plurality of electrical contacts 62. For instance, the electrical signal contacts 40 of the first electrical connector 22 can be placed in electrical communication with the electrical signal contacts 64 of the second electrical connector, and the electrical power contacts 42 of the first electrical connector 22 can be placed in electrical communication with the electrical power contacts 66 of the second electrical connector 24

Figure 4:
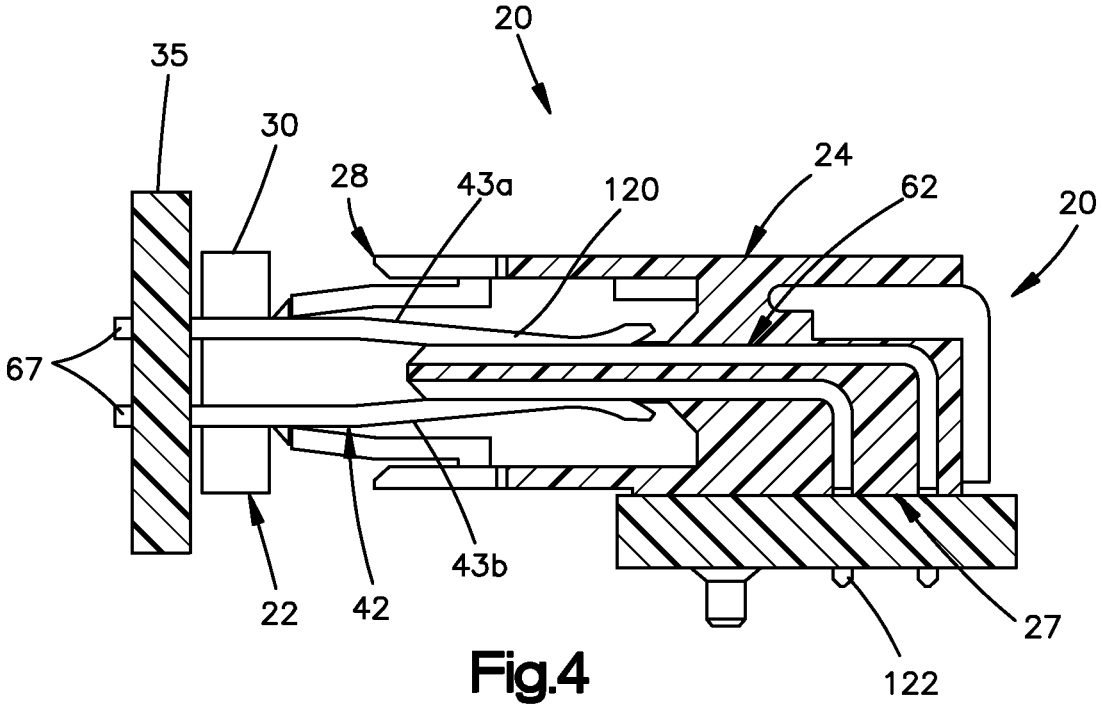
FIG. 4 is a sectional side elevation view of the electrical connector assembly illustrated in FIG. 1A, but showing the first electrical connector mounted to a printed circuit board, and further showing the second electrical connector constructed as a right-angle connector.

In accordance with the illustrated embodiment, the mating interface 28 and the mounting interface 27 are oriented substantially parallel to each other. Thus, the second electrical connector 24 can be referred to as a vertical electrical connector. Further, the mating ends 120 of the second plurality of electrical contacts 62 are oriented substantially parallel to the mounting ends 122. Thus, the second plurality of electrical contacts 62 can be referred to as vertical electrical contacts. It should be appreciated, however, that the second electrical connector 24 can alternatively be a right-angle connector, whereby the mating interface 28 and the mounting interface 27 are oriented substantially perpendicular to each other as illustrated in FIG. 4. Thus, the second plurality of electrical contacts 62 can alternatively be configured as right-angle electrical contacts whereby the mating ends 120 are oriented substantially perpendicular to the mounting ends 122. Furthermore, while the second plurality of electrical contacts 62 are configured as plug contacts whereby the mating ends 120 are configured to be received by the mating ends 39 of the first plurality of electrical contacts 38, the second plurality of electrical contacts 62 can alternatively be configured as receptacle contacts, whereby the mating ends 120 are configured to receive the mating ends 39 of the first plurality of electrical contacts 38.

Referring now to FIGS. 1A-D and 3A-C, and as described above, the electrical connector assembly 20 can include a guidance assembly 72 and an attachment assembly 74. For instance, the first electrical connector 22 can include at least a first guidance member 76 and a first attachment member 78, and the second electrical connector 24 can include a second guidance member 80 and a second attachment member 82. The first and second guidance members 76 and 80 are configured to engage so as to align the first and second electrical connectors 22 and 24 before the mating ends 39 of the first plurality of electrical contacts 38 mate with the mating ends 120 of the second plurality of electrical contacts 62. The first and second attachment members 78 and 82 are configured to mate with each other so as to secure, such as removably secure, the first connector housing 30 to the second connector housing 60 when the mating ends 39 of the first plurality of electrical contacts 38 mate with the mating ends 120 of the second plurality of electrical contacts 62

For instance, one of the first and second guidance members 76 and 80, for instance the first guidance member 76, can be configured as at least one guide socket, and the other of the first and second guidance members 76 and 80, for instance the second guidance member 80, can be configured as at least one guide pin that is sized to extend into the at least one guide socket. In accordance with the illustrated embodiment, the first electrical connector 22 includes first and second guide sockets 77*a* and 77*b* that are supported by the first connector housing 30, and can extend into the housing body 33, for instance rearward along the longitudinal direction L into the front end 33*a* of the housing body 33. The first guide socket 77*a* can be disposed between the first plurality of electrical contacts 38, and in particular the electrical signal contacts 40, and the first side 33*c* of the housing body 33. The second guide socket 77*b* can be disposed between the first plurality of electrical contacts 38, such as the electrical power contacts 42, and the second side 33*d* of the housing body 33.

In accordance with the illustrated embodiment, the second electrical connector 24 includes a first guide pin 86*a* that is carried by the second connector housing 60 and can be disposed between a first side wall of the second connector housing 60 and the second plurality of electrical contacts 62, and a second guide pin 86*b* that is carried by the second connector housing and can be disposed between a second side wall of the second connector housing 60 and the second plurality of electrical contacts 62. The first and second guide pins 86*a-b* can be made from a plastic material, and can be integral and monolithic with the second connector housing 60. Thus, the first guide pin 86*a* is configured to be aligned with the first guide socket 77*a*, and the second guide pin 86*b* is configured to be aligned with the second guide socket 77*b* so as to mate the first electrical connector 22 with the second electrical connector 24. In accordance with the illustrated embodiment, the first and second guide pins 86*a* and 86*b* are elongate along the mating direction M, and terminate at respective distal ends 102*a* and 102*b* that are outwardly spaced from the front end of the second connector housing 60 along the mating direction M. Thus, the distal ends 102*a* and 102*b* are additionally outwardly spaced from the second plurality of electrical contacts 62 with along the mating direction M. As a result, the distal ends 102*a* and 102*b* of the first and second guide pins 86*a* and 86*b* are configured to be received in the respective first and second guide sockets 77*a* and 77*b* before the first plurality of electrical contacts 38 mate with the second plurality of electrical contacts 62.

The first and second guide pins 86*a-b* can be sized substantially equal to (including slightly less than) the first and second guide sockets 77*a-b*. Accordingly, when the first and second guide pins 86*a-b* are received by the first and second guide sockets 77*a-b*, each of the first and second connector housings 30 and 60 are substantially unable to move relative to the other of the first and second connector housings 30 and 60 along a direction that is perpendicular to the mating direction, such as the lateral direction A and the transverse direction T. Further, the first and second guide sockets 77*a-b* and the first and second guide pins 86*a-b* are positioned relative to the first plurality of electrical contacts 38 and the second plurality of electrical contacts 62, respectively, such that the mating ends 120 of the second plurality of electrical contacts 62 are aligned with the gap 63 defined by the mating ends 39 of the first plurality of electrical contacts 38 along the mating direction M. The distal ends 102*a* and 102*b* of the first and second guide pins 86*a-b* can be beveled so as to provide a lead-in to the first and second guide sockets 77*a-b*.

With continuing reference to FIGS. 1A-D and 3A-C, the first connector housing 30 can include at least a first attachment member 78, such as a pair of first attachment members 78 that are supported by the housing body 33 at opposed sides of the housing body 33 along the lateral direction A, and integral and monolithic with the housing body 33. For instance, the first attachment member 78 can include a first latch member 89*a* that is pivotally attached to the first connector housing 30 at a first pivot location 114*a* that is disposed outboard with respect to the first guide socket 77*a* along the lateral direction A, such that the first guide socket 77*a* is disposed between the first plurality of electrical contacts 38 and the first pivot location 114*a*. The first attachment member 78 can further include a second latch member 89*b* that is pivotally attached to the first connector housing 30 at a second pivot location 114*b* that is disposed outboard with respect to the second guide socket 77*b* along the lateral direction A, such that the second guide socket 77*b* is disposed between the first plurality of electrical contacts 38 and the second pivot location 114*b*.

The first latch member 89*a* can include a first latch arm 90*a* that is pivotally supported by the first connector housing 30 so as to pivot about the first pivot location 114*a*, which defines a pivot axis that extends along the transverse direction T. The first latch arm 90*a* is configured to pivot about the first pivot location 114*a* in a first attachment direction which causes the first latch member 89*a* to mate with a complementary second attachment member 82 of the second electrical connector 24. Similarly, the second latch member 89*b* can include a second latch arm 90*b* that is pivotally supported by the first connector housing 30 so as to pivot about the second pivot location 114*b*, which defines a pivot axis that extends along the transverse direction T. The second latch arm 90*b* is configured to pivot about the second pivot location 114*b* in the first attachment direction which causes the second latch member 89*b* to mate with a complementary second attachment member 82 of the second electrical connector 24. The first and second latch arms 90*a* and 90*b* are further configured to pivot about the respective first and second pivot locations 114*a* and 114*b* along a second or detachment direction that is opposite the first direction and configured to disengage the first and second latch members 89*a* and 89*b* from the complementary second attachment member 82 of the second electrical connector 24.

The first latch member 89*a* can further include a first barb 92*a* that can extend from a first or front end of the first latch arm 90*a* into an opening of the first connector housing 30, such as a first opening 106*a* that extends between the top and bottom ends 33*e* and 33*f*, respectively, of the housing body 33. The first opening 106*a* is further open to the first guide socket 77*a* along the lateral direction A. In accordance with the illustrated embodiment, the first barb 92*a* projects inwardly along the lateral direction A from the first latch arm 90*a*. The first latch arm 90*a* can be laterally outwardly disposed with respect to the first guide socket 77*a*. The first latch member 89*a* can further carry a spring member, such as a first spring member 94*a*, that extends from a second or the rear end of the first latch arm 90*a*. Thus, the first pivot location 114*a* is disposed between the first barb 92*a* and the first spring member 94*a*. The first spring member 94*a* is disposed outward with respect to the first side 33*c* of the housing body 33, and can be configured as a resilient and flexible arm that has a portion that is spaced from the first latch arm 90*a* along the lateral direction A.

The first spring member 94*a* is configured to abut and resiliently compress against the housing body 33, for instance at the first side 33*c*, as the first latch arm 90*a* pivots in the detachment direction, which causes the rear end of the first latch arm 90*a* to move in a first direction, such as inward toward the first plurality of electrical contacts 38, and causes the front end of the first latch arm 90*a*, and thus the first barb 92*a* to move in an opposed second direction, such as outward away from the first plurality of electrical contacts 38. It should be appreciated that when the first spring member 94*a* is compressed against the housing body 33, the first spring member 94*a* applies a biasing force to the rear end of the first latch arm 90*a* that biases the first latch arm 90*a* to move in the attachment direction, such that the rear end of the first latch arm 90*a* moves in the second direction, for instance away from the first plurality of electrical contacts 38, and the front end of the first latch arm 90*a*, and thus the first barb 92*a* moves in the first direction, for instance toward the first plurality of electrical contacts 38.

Similarly, the second latch member 89*b* can further include a second barb 92*b* that can extend from a first or front end of the second latch arm 90*b* into an opening, such as a second opening 106*b* that extends between the top and bottom ends 33*e* and 33*f*, respectively, of the housing body 33. The second opening 106*b* is further open to the second guide socket 77*b* along the lateral direction A. In accordance with the illustrated embodiment, the second barb 92*b* projects inwardly along the lateral direction A from the second latch arm 90*b*. The second latch arm 90*b* can be laterally outwardly disposed with respect to the second guide socket 77*b*. The second latch member 89*b* can further carry a spring member, such as a second spring member 94*b*, that extends from a second or rear end of the second latch arm 90*b*. Thus, the second pivot location 114*b* is disposed between the second barb 92*b* and the second spring member 94*b*. The second spring member 94*b* is disposed outward with respect to the second side 33*d* of the housing body 33, and can be configured as a resilient and flexible arm that has a portion that is spaced from the second latch arm 90*b* along the lateral direction A.

The second spring member 94*b* is configured to abut and resiliently compress against the housing body 33, for instance at the second side 33*d*, as the second latch arm 90*b* pivots in the detachment direction, which causes the rear end of the second latch arm 90*b* to move in a first direction, such as inward toward the first plurality of electrical contacts 38, and causes the front end of the second latch arm 90*b*, and thus the second barb 92*b* to move in an opposed second direction, such as outward away from the first plurality of electrical contacts 38. It should be appreciated that when the second spring member 94*b* is compressed against the housing body 33, the second spring member 94*b* applies a biasing force to the rear end of the second latch arm 90*b* that biases the second latch arm 90*b* to move in the attachment direction, such that the rear end of the second latch arm 90*b* moves in the second direction, for instance away from the first plurality of electrical contacts 38, and the front end of the second latch arm 90*b*, and thus the second barb 92*b* moves in the first direction, for instance toward the first plurality of electrical contacts 38.

The second attachment member 82 can be carried by a corresponding one of the second guidance member 80, and is configured to releasably secure the first attachment member 78 when the first and second electrical connectors 22 and 24 are mated. For instance, the second attachment member 82 can include a latch member configured as a first projection 96*a* that is carried by the first guide pin 86*a*, and can extend out from the first guide pin 86*a* along a direction that is angularly offset, such as substantially perpendicular, with respect to the mating direction M. In accordance with the illustrated embodiment, the first projection 96*a* extends from the first guide pin 86*a* along a direction away from the second plurality of electrical contacts 62, such that the first guide pin 86*a* is disposed between the first projection 96*a* and the second plurality of electrical contacts 62. The second attachment member 82 can include a second latch member configured as a second projection 96*b* that is carried by the second guide pin 96*b*, and can extend out from the second guide pin 86*b* along a direction that is angularly offset, such as substantially perpendicular, with respect to the mating direction M. In accordance with the illustrated embodiment, the second projection 96*b* extends from the second guide pin 86*b* along a direction away from the second plurality of electrical contacts 62, such that the second guide pin 86*b* is disposed between the second projection 96*b* and the second plurality of electrical contacts 62. The first and second projections 96*a-b* can be made from a plastic material, and can be integral and monolithic with the first and second guide pins 86*a-b*, and can thus further be integral and monolithic with the second connector housing 60.

During operation, the first and second guide pins 86*a-b* are received in the first and second guide sockets 77*a-b*, respectively, before the first and second pluralities of electrical contacts 38 and 62, respectively, mate with each other. The first and second pluralities of electrical contacts 38 and 62, respectively, are mated with each other when the first and second guide pins 86*a-b* are fully seated in the respective first and second guide sockets 77*a-b*. As the first and second guide pins 86*a-b* are received in the respective first and second guide sockets 77*a-b*, the first and second projections 96*a-b* extend from the respective first and second guide sockets 77*a-b* into the first and second openings 106*a-b*. The first and second barbs 92*a-b*, which can be at least partially disposed in the first and second openings 106*a-b*, each of which can define a beveled front surface, engage the projections 96*a-b*, and ride along and past the respective first and second projections 96*a-b*, which causes the first and second spring members 94*a-b* to compress against the housing body 33, until the first and second barbs 92*a-b* travel behind the complementary first and second projections 96*a-b*. The first and second spring members 94*a-b* apply a biasing force that biases the first and second latch members 89*a-b* to pivot about the respective first and second pivot locations 114*a-b* along the attachment direction, which causes the first and second barbs 92*a-b* to move in the first direction, such as toward the respective first plurality of electrical contacts 38, which causes a rear end of the first and second barbs 92*a-b* to be positioned in alignment with the complementary first and second projections 96*a-b*. As a result, after the first and second electrical connectors 22 and 24 are mated, the first and second barbs 92*a-b* interfere with the respective first and second projections 96*a-b* so as to prevent each of the first and second electrical connectors 22 and 24 from moving relative to the other of the first and second electrical connectors 22 and 24 along a direction opposite the mating direction so as to unmate the first and second electrical connectors 22 and 24 from each other.

A laterally inward force can be applied to the rear ends of one or both of the first and second latch arms 90*a-b* that causes the first and second latch members 94*a-b* move along the detachment direction about the respective first and second pivot locations 114*a-b*. Thus, the rear ends of the first and second latch arms 90*a-b* move toward the housing body, which in turn compresses the corresponding first and second spring members 94*a-b* against the housing body, and causes the front ends of the first and second latch arms 90*a-b* and first and second barbs 92*a-b* to move away from the first plurality of electrical contacts 38, and thus away from the complementary first and second projections 96*a-b* until the first and second barbs 92*a-b* are out of alignment with the first and second projections 96*a-b*, at which point either or both of the first and second electrical connectors 22 and 24 can be moved away from the other of the first and second electrical connectors 22 and 24, so as to unmate the first and second electrical connectors 22 and 24.

It should be appreciated that while the first guidance member 76 of the first electrical connector 22 is configured as at least one socket and the second guidance member 80 of the second electrical connector 24 is configured as at least one guide pin as described above, it should be appreciated that the first guidance member 76 can alternatively be configured as at least one guide pin constructed as described above, and the second guidance member 80 can be configured as at least one guide socket constructed as described above. Furthermore, while the first attachment member 78 of the first electrical connector 22 is configured as at least one latch member and the second attachment member 82 of the second electrical connector 24 is configured as at least one projection as described above, it should be appreciated that the first attachment member 78 can alternatively be configured as at least one projection that is constructed as described above, and the second attachment member 82 can be configured as at least one latch member constructed as described above.

The embodiments described in connection with the illustrated embodiments have been presented by way of illustration, and the present invention is therefore not intended to be limited to the disclosed embodiments. Accordingly, those skilled in the art will realize that the invention is intended to encompass all modifications and alternative arrangements included within the spirit and scope of the invention, for instance as set forth by the appended claims

What is claimed:

1. An electrical connector configured to mate with a complementary electrical connector along a mating direction, the electrical connector comprising:

a connector housing and a plurality of electrical contacts that are supported by the connector housing, the plurality of electrical contacts configured to mate with electrical contacts of the complementary electrical connector at a mating interface;

a guidance member that is configured to engage a complementary guidance member of the complementary electrical connector so as to align the electrical connector with the complementary electrical connector; and a latch member that projects from the guidance member along a direction that is substantially perpendicular to the mating direction at a location spaced from both the proximal end and the distal end with respect to the mating direction, wherein the latch member is configured to engage a latch member of the complementary electrical connector so as to secure the electrical connector and the complementary electrical connector when the electrical connector is mated with the complementary electrical connector.

2. The electrical connector as recited in claim 1, wherein the latch member is configured to releasably secure the electrical connector and the complementary electrical connector when mated.

3. The electrical connector as recited in claim 1, wherein the guidance member comprises a guide pin that projects forward from a front end of the connector housing.

4. The electrical connector as recited in claim 3, wherein the latch member comprises a projection that extends out from the guide pin.

5. The electrical connector as recited in claim 4, wherein the projection extends away from the plurality of electrical contacts.

6. The electrical connector as recited in claim 4, wherein the electrical connector is configured to mate with the complementary electrical connector along the mating direction, and the guide pin is elongate in the mating direction.

7. The electrical connector as recited in claim 1, wherein the electrical contacts include signal contacts and power contacts.

8. The electrical connector as recited in claim 1, wherein the latch member is rigid such that the latch member does not deflect toward or away from the guidance member as the latch member engages the latch member of the complementary electrical connector.

9. The electrical connector as recited in claim 1, wherein the guidance member has a proximal end that is adjacent to the connector housing and a distal end that is spaced along a mating direction from the proximal end, and wherein the latch member projects from the guidance member at a location spaced from both the proximal end and the distal end with respect to the mating direction.

10. An electrical connector assembly comprising:

a first electrical connector including a first connector housing and a first plurality of electrical contacts supported by the first connector housing, a first guidance member carried by the first connector housing, and a first at least one latch member carried by the first connector housing; and a second electrical connector configured to mate with the first electrical connector along a mating direction, the second electrical connector including a second connector housing and a second plurality of electrical contacts that are supported by the second connector housing, a second guidance member carried by the second connector housing, and a second at least one latch member that is carried by the second guidance member and projects locally-from the second guidance member along a direction that is substantially perpendicular to the mating direction, wherein the first and second guidance members are configured to mate with each other so as to align the first and second electrical connectors to be mated, and the first at least one latch member is configured to mate with the second at least one latch member so as to secure the first electrical connector to the second electrical connector when the first and second electrical connectors are mated to each other along the mating direction.

11. The electrical connector assembly as recited in claim 10, wherein the first guidance member comprises a socket that is carried by the first connector housing, and the second guidance member comprises a guide pin configured to be received in the socket.

12. The electrical connector assembly as recited in claim 11, wherein the guide pin defines a distal end that is outwardly spaced from the second connector housing.

13. The electrical connector assembly as recited in claim 11, wherein the second at least one latch member comprises a projection that extends out from the guide pin.

14. The electrical connector assembly as recited in claim 13, wherein the guide pin is elongate along the mating direction, and the projection extends out from the guide pin along a second direction that is substantially perpendicular to the mating direction.

15. The electrical connector assembly as recited in claim 13, wherein the guide pin is disposed between the second plurality of electrical contacts and the projection.

16. The electrical connector assembly as recited in claim 15, wherein the projection extends from the guide pin along a direction away from the second plurality of electrical contacts.

17. The electrical connector assembly as recited in claim 13, wherein the first at least one latch member includes a latch arm that is pivotally attached to the first connector housing at a pivot location, and a barb that is carried by the latch arm and disposed in an opening that is defined by the first connector housing, wherein the opening is open to the socket along a direction that is substantially perpendicular to the mating direction.

18. The electrical connector assembly as recited in claim 17, wherein the projection extends into the opening when the guide pin is disposed in the socket, such that the barb engages the projection so as to prevent each of the first and second electrical connectors from moving along a direction opposite the mating direction with respect to the other of the first and second electrical connectors.

19. The electrical connector assembly as recited in claim 10, wherein the second at least one latch member can be placed in 1) a disengaged configuration whereby the second at least one latch member is not engaged with the first at least one latch member and 2) an engaged configuration whereby the second at least one latch member is engaged with the first at least one latch member, and wherein the second at least one latch member has a first end and a second end that is spaced from the first end along the direction that is substantially perpendicular to the mating direction, and the first end and the second end are at fixed positions in the engaged configuration and the disengaged configuration.

20. The electrical connector assembly as recited in claim 10, wherein the second guidance member has a proximal end that is adjacent to the second connector housing and a distal end that is spaced along the mating direction from the proximal end, and wherein the second at least one latch member projects from the second guidance member at a location spaced from both the proximal end and the distal end with respect to the mating direction.

21. An electrical connector configured to mate with a complementary electrical connector along a mating direction, the electrical connector comprising:

a connector housing and a plurality of electrical contacts that are supported by the connector housing, the plurality of electrical contacts configured to mate with electrical contacts of the complementary electrical connector at a mating interface;

a guide socket that is supported by the connector housing and configured to receive a guide pin of the complementary electrical connector along the mating direction so as to align the electrical connector with the complementary electrical connector; and a latch member including a latch arm that is pivotally attached to the connector housing at a pivot location, and a barb that is carried by the latch arm and disposed in an opening that is defined by the connector housing, wherein the opening is open to the guide socket along a direction that is substantially perpendicular to the mating direction, such that the barb is configured to engage a latch member of the complementary electrical connector as the guide socket receives the guide pin.

22. The electrical connector as recited in claim 21, wherein the latch member is configured to releasably secure the electrical connector and the complementary electrical connector when mated.

* * * * *